United States Patent [19]

de Vos

[11] Patent Number: 4,825,792

[45] Date of Patent: May 2, 1989

[54] MAST FOR A SAILBOARD

[75] Inventor: Jacob de Vos, Oud-Beijerland, Netherlands

[73] Assignee: Koni B.V., Oud-Beijerland, Netherlands

[21] Appl. No.: 95,899

[22] Filed: Sep. 14, 1987

[30] Foreign Application Priority Data

Sep. 12, 1986 [NL] Netherlands ..... 8602319

[51] Int. Cl.[4] ..... B63B 15/02

[52] U.S. Cl. ..... 114/90; 441/74; 267/64.28

[58] Field of Search ..... 267/64.15, 64.28, 64.11; 441/74, 65; 114/89, 90, 91, 92, 93, 94; 188/322.15, 281, 282, 322.22, 322.11, 322.13, 297, 266

[56] References Cited

U.S. PATENT DOCUMENTS

| | | | |
|---|---|---|---|
| 4,073,254 | 2/1978 | Marker | 114/92 |
| 4,462,327 | 7/1984 | Petramer | 114/90 |
| 4,493,659 | 1/1985 | Iwashita | 440/61 |
| 4,529,180 | 7/1985 | Hill | 267/64.28 |
| 4,593,890 | 6/1986 | van der Laarse | 267/64.28 |
| 4,646,884 | 3/1987 | Yang | 267/64.28 |

*Primary Examiner*—Joseph F. Peters, Jr.
*Assistant Examiner*—Clifford T. Bartz
*Attorney, Agent, or Firm*—Cushman, Darby & Cushman

[57] ABSTRACT

To counteract stress peaks on a sailboard exerted by the bottom end of the mast, this bottom end is provided with a shock absorber formed by an oil filled cylinder and a piston with piston rod displaceable therein. The piston is provided with passages. The flow of oil through these passages is governed by valve means.

8 Claims, 1 Drawing Sheet

MAST FOR A SAILBOARD

BACKGROUND OF THE INVENTION

1. Field of the Art

The invention relates in the first instance to a mast for a sailboard.

2. Background of the Art

In the course of sailing with a sailboard, high peak stresses are exerted on the board by the bottom end of the mast during heavy weather. Extremely high stresses occur in particular in competition sailboarding. They can lead to damage to the board. It is known to provide an elastic element between mast and board. The elastic element has little effect on absorbing the up and down movement of the mast. The mast remains moving and, through the elastic deformation of the element, the amplitude of the mast movement in a direction perpendicular to the board will even be greater than the amplitude of the board movement in the same direction. The often jerking, turbulent movement of the mast also has an adverse effect on the joints of the sailboard.

SUMMARY OF THE INVENTION

The object of the invention is to eliminate these disadvantages and to produce a sailboard mast which follows the up and down movement of the sailboard on which it is fixed, in such a way that the stress peaks on the board are counteracted to a considerable extent and the mast exhibits a smoother movement pattern.

According to the invention, the mast is to this end characterized in that the bottom end thereof is provided with a shock absorber, formed by a cylinder filled with oil and a piston with piston rod displaceable therein, while in the piston provision is made for passages, and the flow of oil through said passages is governed by valve means. The oil meets with resistance when passing through the passages and the valve means. Energy is converted to heat in the process. It is expected that, through the more stable mast position, the sailboard can travel faster. In any case, the sailboard will be less likely to suffer damage due to jolting stresses through the mast.

The combination of springing and shock absorption is achieved if the shock absorber is also provided with a gas spring.

In order to be able to fix the shock absorber in a simple manner to the bottom end of the mast, it can be pushed into the bottom end of the mast and held in place by an adaptor which is detachably connected both to the bottom end of the shock absorber and to the bottom end of the mast.

The adaptor is preferably screwed to the shock absorber and connected to the mast by spring-loaded pins projecting through holes into the mast.

The invention also relates to a sailboard with a mast of the above-described type. The piston rod of the shock absorber is fixed at its bottom end to a coupling element which gives in various directions.

The coupling element is preferably a cardan joint, although a simple elastic element, for example in the form of a diabolo, is also possible.

In order to limit the movements towards each other of mast and board without jolts, provision is made between the bottom end of the mast and the coupling element for an elastic stroke limiting device.

BRIEF DESCRIPTION OF THE DRAWINGS

The invention will now be explained in greater detail with reference to FIG. 1, in which an example of an embodiment is shown.

DETAILED DESCRIPTION OF THE PREFERRED EMBODIMENT

Figure 1:
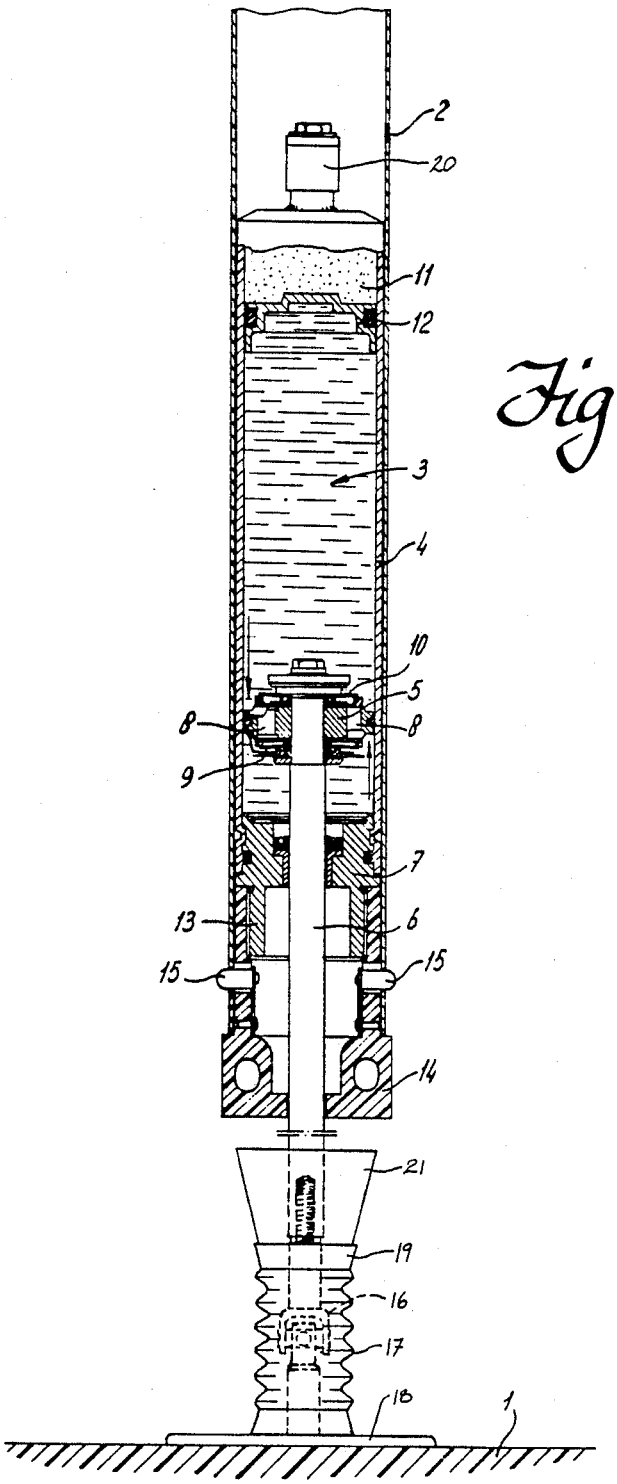
FIG.1 shows part of a sailboard with the bottom part of the mast thereof in cross section.

In FIG. 1, the sailboard is indicated by 1, and the hollow mast by 2. Slid into the mast is a shock absorber 3, comprising a cylinder 4, a piston 5, a piston rod 6, and a guide head 7 for guiding the piston rod. Disposed in the piston 5 are passages 8 which are regulated by non-return valves 9, 10, in a manner known per se, in such a way that both on the ingoing and the outgoing stroke of the piston the oil flows from one side to the other and thereby meets with considerable resistance and produces the shock absorption.

Fitted in the top end of the shock absorber is a gas spring 11, comprising a quantity of compressed gas which is separated from the oil by a sealed partition 12. The outward thrust of the gas spring can be brought into balance with the overall mast load by means of a filling system 20.

For the purpose of retaining the shock absorber 3 in the desired position in the mast, the guide head 7 has a collar 13, which is provided with an external screw thread, and on which an adaptor 14 provided with an internal screw thread is screwed. This adaptor projects partially into the mast and has a number of pins 15 which are movable against spring action and project through openings into the bottom end of the mast 2.

It will be clear that the shock absorber can easily be replaced by pressing the pins 15, sliding the combination of shock absorber 3 and adaptor 14 out of the mast, unscrewing the adaptor from the shock absorber, screwing another shock absorber (for example, one with a different shock absorption characteristic) onto the adaptor, and sliding all this into the mast until the pins 15 project again through the openings into the mast.

The bottom end of the piston rod is provided with screw thread and is connected by means of a screw connection to a universal (cardan) joint 16 known per se, which permits hingeing in two directions perpendicular to each other. The said screw connection is secured by a nut with spring ring. This universal joint is incorporated in a bellows 17 and is fixed to a plate 18 which is anchored either in a fixed position or movably in a slide on the sailboard 1.

Disposed on the top part of the universal joint is a disc 19, which serves to support an elastic stroke limiting device 21.

It will be clear that many modifications are possible within the scope of the invention. For example, the shock absorber 3 could be disposed between the bottom end of the mast 2 and the stroke limiting device 21, instead of in the mast. The universal joint 16 could be replaced by an ordinary diabolo-type elastic element which permits movements in all transverse directions. For the connection between the shock absorber and the mast there are many possibilities. Nor are there any limits to the way in which the bottom end of the piston rod is connected to the universal joint or diabolo. What is important is that peak stresses which would be exerted by the mast on the board are absorbed by a shock absorber which is provided on the bottom end of the mast, and which is preferably provided with a gas spring, although a steel screw spring or a spring element made of elastic material are also conceivable.

I claim:

1. An apparatus for use with a sailboard comprising:

a sailboard mast; and means for shock absorbing disposed at a bottom end of said sailboard mast, said shocking absorbing means including;

an oil-filled cylinder, a piston disposed in said cylinder, said piston including means for passing said oil through said piston and valve means for regulating said passing means, and a piston rod connected to one end of said piston.

2. An apparatus according to claim 1 wherein said shock absorbing means includes a gas spring.

3. An apparatus according to claim 2 wherein said gas spring includes a filling system for adjusting a pressure of said gas spring to various weights of said sailboard.

4. An apparatus according to claim 1 wherein said shock absorbing means is inserted into said bottom end of said mast and is held in place by an adapter that is detachably connected to both a bottom end of said shock absorbing means and said bottom end of said sailboard mast.

5. An apparatus according to claim 4 wherein said adapter is screwed into said shock absorbing means and connected to said sailboard mast with a plurality of spring pins that project through holes into said sailboard mast.

6. An apparatus according to claim 1 wherein said piston rod is connected at its outer end to a coupling element.

7. An apparatus according to claim 6 wherein said coupling element is a universal joint.

8. An apparatus according to claim 6 further including an elastic stroke limiting device fitted between said bottom end of said mast and said coupling element.

* * * * *